US008763173B2

(12) United States Patent
Tortorella et al.

(10) Patent No.: US 8,763,173 B2
(45) Date of Patent: Jul. 1, 2014

(54) STAINLESS STEEL PLUMBING FIXTURES WITH RESISTANT COATINGS

(75) Inventors: Nathan F. Tortorella, Sheboygan, WI (US); Christopher T. Wagner, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 733 days.

(21) Appl. No.: 12/510,297

(22) Filed: Jul. 28, 2009

(65) Prior Publication Data

US 2010/0077547 A1 Apr. 1, 2010

Related U.S. Application Data

(60) Provisional application No. 61/100,453, filed on Sep. 26, 2008.

(51) Int. Cl.
*A47K 1/04* (2006.01)

(52) U.S. Cl.
USPC ..... 4/619

(58) Field of Classification Search
CPC ..... E03C 1/00; E03C 1/18
USPC ..... 4/619–620
See application file for complete search history.

(56) References Cited

U.S. PATENT DOCUMENTS

| | | | | |
|---|---|---|---|---|
| 1,511,555 | A | 10/1924 | Yngve | |
| 2,950,839 | A | 8/1960 | Hahn | |
| 3,730,489 | A | 5/1973 | Morita | |
| 5,744,013 | A | 4/1998 | Botts et al. | |
| 6,541,450 | B1 | 4/2003 | Barbier et al. | |
| 6,989,087 | B2 | 1/2006 | Lansdell et al. | |
| 7,320,832 | B2 | 1/2008 | Palumbo et al. | |
| 7,354,354 | B2 | 4/2008 | Palumbo et al. | |
| 7,896,061 | B2 * | 3/2011 | Nakai et al. | 164/418 |
| 2005/0154112 | A1 | 7/2005 | Shigeru et al. | |
| 2008/0115267 | A1 | 5/2008 | Konno et al. | |

FOREIGN PATENT DOCUMENTS

| | | |
|---|---|---|
| DE | 19907212 | 8/2000 |
| DE | 102006058753 | 6/2008 |
| EP | 1854908 | 11/2007 |

OTHER PUBLICATIONS

Article by D. Roshard entitled "Metal Coated Sinks" from web site, undated admitted prior art.
Article by N. Zaki entitled "Chromium Plating" on pfonline web site, undated, admitted prior art.
Article excerpt from MIT Technology Insider, entitled "Shiny and New" dated Apr. 2007.
Eight pages of a PCT search report of PCT/US2009/004606 dated Nov. 24, 2009 in a corresponding PCT application.

* cited by examiner

*Primary Examiner* — Lori Baker
(74) *Attorney, Agent, or Firm* — Foley & Lardner LLP

(57) ABSTRACT

Stainless steel sinks are disclosed which have a chrome surface coating layer. In one highly preferred form the layer is electroplated in a non-uniform manner such that high wear areas automatically receive an extra thickness of the chrome. The layer improves stain resistance and scratch resistance well beyond what conventional chromium mixed throughout the stainless steel itself will do. Processes for applying the layer are also described, as are the effects of different brushing finishes.

20 Claims, 4 Drawing Sheets

STAINLESS STEEL PLUMBING FIXTURES WITH RESISTANT COATINGS

CROSS-REFERENCES TO RELATED APPLICATIONS

This application claims priority based on U.S. provisional application 61/100,453 filed on Sep. 26, 2008.

STATEMENT REGARDING FEDERALLY SPONSORED RESEARCH

Not Applicable.

BACKGROUND OF THE INVENTION

The present invention relates to stainless steel sinks which have improved scratch and stain resistance.

Consumers desire that their kitchen sink appear "like new" over the full lifetime of the sink. However, basin surfaces of such sinks are typically subjected to contact with sharp utensils and heavy pots, certain hard ceramic dishware, harsh chemicals and aggressive cleaning practices.

For example, consumers sometimes try to scrub sinks with highly abrasive steel wire scrubbing pads. Also, sharp carving knives are occasionally accidentally dropped into, or banged against top edges of, such basins. Further, ceramic coffee mugs and dinner plates have a tendency to scratch soft sink surfaces when accidentally dragged against them as the cups and dishes are being washed in the sink.

Conventional sink materials that are the most susceptible to scratching (and in some cases susceptible to staining) include plastics (e.g. thermoformed acrylics) and certain stainless steels. As a result, enameled cast iron is often more sought after in preference to sinks made of such other materials. However, there can be a considerable cost differential between enameled cast iron sinks and stainless steel or plastic sinks.

One approach to reduce the visual prominence of scratching on a conventional stainless steel sink involves pre-texturing the surface of the sink basin. See e.g. WO 2006064883. This idea of hiding the scratching "in plain sight" reduces the visibility of some scratches. However, it also limits the aesthetic design options.

Another alternative is to alter the chemical content of the stainless steel itself. With certain additives inside the steel the hardness of the steel can be adjusted somewhat. However, this approach has its limitations, and when pushed too far can adversely affect the production process or performance characteristics.

There have also been attempts to coat such sinks with a protective surface coating. In some cases this can adversely affect the appearance of the sink. In others, this can increase costs which are not sufficiently justified by the degree of improvement.

For example, Toto has proposed using microscopic beads of fluorinated polymer dispersed in a layer of ceramic silica as a protection for sinks. However, this coating is susceptible to scratching from certain sources.

As another example U.S. patent application publication 20050154112 described a coating based on sol-gel processing and contained silicon and zirconium as the primary film-forming constituents. Although silicon dioxide and zirconium dioxide are very hard materials, the surface of a stainless steel sink coated with this sol-gel material can still be too easily scratched/dented with a stainless steel knife when the layer is thin, and thicker coating layers can be susceptible to cracking.

Others have tried use of silicate coatings. See e.g. EP 1854908. If the silicate coating is too thin, a stainless steel knife will easily scratch the surface. Above a certain thickness, the coating will crack or discolor if processed in a normal manner.

Still others have tried depositing a titanium nitride coating on stainless steel sinks. This process is very expensive and time consuming.

In U.S. Pat. No. 1,511,555 there was described the deposition of metallic chromium on steel in an electroplating process to create a tool. However, there was no suggestion to apply these teachings to the sink art, much less a suggestion as to how to optimize coating thicknesses to accommodate wear variations at different locations along the sink.

U.S. Pat. No. 2,950,839 taught that stainless steel bread pans could have plated thereon a thick intermediate layer of chromium, followed by treatment of the chromium layer to form an oxide on the chrome layer's outer surface. This patent was focused on how to permit easy removal of food from the pan, and involved modified surface appearance.

U.S. Pat. No. 3,730,489 taught use of a chrome layer on a stainless steel vibrating board associated with a tank. The thickness of the layer of chrome was set for various reasons associated with the vibrating board's function. In any event the tank itself was not coated.

There have also been prior art suggestions to include substantial amounts of chromium in the chemical formula for stainless steel itself, and then use that chromium steel to form kitchen sinks. However, these sinks are the very ones in need of considerable improved scratch and stain resistance.

Also, there have been a variety of teachings and suggestions to apply chrome finishes to certain metal products to improve decorative finish (e.g. an auto bumper). However, particularly recently, some have suggested that use of chrome coatings should be minimized or avoided due to environmental difficulties experienced in handling one of the typical reagents used to form such coatings in some processes.

Accordingly, there exists a need for improving the resistance characteristics of stainless steel sinks, without adversely compromising other desired features and attributes of the sink or how it is made.

SUMMARY OF THE INVENTION

In one aspect the invention provides a plumbing fixture which has at least one basin, a rim extending outward from an upper portion of the basin, and at least one outlet extending downward from a lower portion of the basin. The basin has a metallic base layer over which is positioned an exposed layer of chrome.

A first portion of the exposed layer of chrome adjacent a junction between the rim and a top portion of a basin side wall has a first thickness which is greater than 20 microns thick. A second portion of the exposed layer of chrome forming a portion of an upwardly facing floor of the basin has a second thickness which is greater than 20 microns thick. A third portion of the exposed layer of chrome adjacent a junction between a lower portion of the basin side wall and the floor of the basin has a third thickness (which while greater than 1 micron thick is less thick than the first and second thicknesses).

The thicknesses are such as to protect the sink with thicker chrome layer near the highest wear points, without requiring such thickness at other places less susceptible to wear. This is achieved in a highly efficient, automatable and reliable manner, and greatly improves resistance over simply including chromium in the metallic base layer itself.

For example, the intersection of the top rim with the basin top wall could have a micron thickness above even 50 microns, the floor of the basin could have a micron thickness of 20 to 40 microns, and the junction between the basin side wall and floor (which is subject to much less wear and scratch risk) could have a thickness of just 1 to 15 microns.

The plumbing fixture is preferably a sink (e.g. a double basin kitchen sink), but may be other basin type plumbing fixtures such as a laundry utility basin. We highly prefer that the metallic base layer be formed of stainless steel, and that the chrome layer will comprise at least 90% (preferably at least 95%, e.g. 100%) chromium.

The term "stainless steel" with reference to the base layer is intended to mean an iron/carbon-based material that has added to it other additives. Typical alloy additives include nickel (e.g. 4-40%) and chromium (e.g. 12-20%). The combination of both chromium (at about 18%) and nickel (at about 8%) produces metastable austenitic stainless steel. This type of stainless steel has good press-forming properties.

The chrome layer can directly abut against the metallic base layer, and the upwardly facing portion of the fixture which the public sees after installation can be coated with chrome even though none of the opposite bottom surface need be coated.

The exposed layer of chrome is preferably deposited on a base portion after the base portion has been formed into its sink/rim/basin shape, albeit one could first chrome coat a flat sheet of the base layer and then form the basin shape. However, the latter approach risks damaging the chrome coating during the shaping step.

It is also preferred to apply the exposed layer of chrome using an electroplating (a/k/a electrodepositing) process. In this process the passage of current through a solution is associated with the movement of ions (charged particles) through it. The terminals leading the current into the solution are electrodes.

The pole at which the oxidation chemical reactions take place is the anode. The pole at which the reactions are reductions is the cathode. In an electrolytic cell, which draws its current from an outside source such as a battery or rectifier, the anode is the positive electrode and the cathode the negative electrode. The ions that move or migrate toward the anode are anions and have a negative charge, while the ions that migrate toward the cathode are cations and they have a positive charge. The charge running through the solution can, for example, remove the oxygen from an oxidized chromium compound, allowing the freed chromium to deposit on a surface to be coated.

There may be one or more cleaning or surface preparation stages to improve adhesion of the electroplated metal. For example, one can use one or more of hand wiping, solvent degreasing, emulsion cleaning, alkaline spray, or chemical polishing, before the base layer is placed in the electroplating bath.

Etching may also be used, albeit not primarily for its cleaning properties. Etching will "roughen" the surface to achieve better adhesion of chromium to the base material. Etch time may be about 25 seconds using a chromic acid solution, as one example.

The exposed chromium layer may comprise minor amounts of oxides and metallic impurities. For example, iron, copper, nickel, zinc, and other metallic impurities may enter the bath and either modify the process or be co-deposited with the chromium. The chromium deposit may also contain organic materials as well.

The plumbing fixtures of the present invention may achieve a Vickers hardness of 600 or greater along the exposed chrome layer and thus the chrome layer can avoid being scraped even when challenged with a Mohs hardness 6 pick with a load of 100 grams.

Most preferably the base layer has at least in part been brushed to create a finish surface, prior to the application of the chrome layer.

In another aspect the invention provides a method for forming a kitchen sink of the type having at least one basin, a rim extending outward from an upper portion of the basin, and at least one outlet extending downward from a lower portion of the basin. The formed sink will have a stainless steel base layer over which is positioned an exposed layer of chrome which has a portion which is at least 10 microns thick.

In performing the method one obtains the stainless steel base layer, positions an anode that in part mimics contours of an upper side of the base layer adjacent the upper side of the base layer, positions a cathode adjacent a lower side of the base layer, and places the base layer with anode and cathode so positioned in an electroplating bath. Then, using an electroplating process, one then deposits a layer of chrome on the base layer, wherein the chrome layer is not of uniform thickness.

For optimal performance the entire upper surface that is exposed to view after sink installation should have a chrome thickness of at least 1 micron (preferably at least 5 microns), with light wear areas having a thickness of at least 10 microns, and areas subject to the highest risk of scratching having a thickness of at least 20 (preferably at least 50) microns. By careful control of the contours of the anode, the relative thicknesses can be precisely and automatically achieved without disrupting the decorative appearance.

The areas of the sink most susceptible to staining (e.g. the floor of the basin) should also have a stain resistant surface capable of passing stain resistant standard ANSI Z.124.6.5.2-2007. This is achievable with the sinks of the present invention. Most importantly, the sink can appear to the naked eye not significantly altered from the perceived aesthetics of a standard stainless steel sink.

The cost of adding the chrome layer is kept to a minimum by only using the most thick layering where needed. Further, as chromium has long been safely used as part of stainless steel sinks, obtaining regulatory clearances to use the sink in a food environment are simplified.

What is particularly unexpected is that a chemical that has long been inside stainless steel at significant levels (chromium) provides a marked wear resistance improvement when used in a separate layer. Further, by keeping the thickness of the chrome layer relatively thin, coating cracking issues can be minimized.

The foregoing and other advantages of the present invention will become apparent from the following description. In that description reference will be made to the accompanying drawings which form a part thereof, and in which there is shown by way of illustration example embodiments of the invention. The example embodiments do not limit the full scope of the invention.

DETAILED DESCRIPTION OF THE INVENTION

Figure 1:
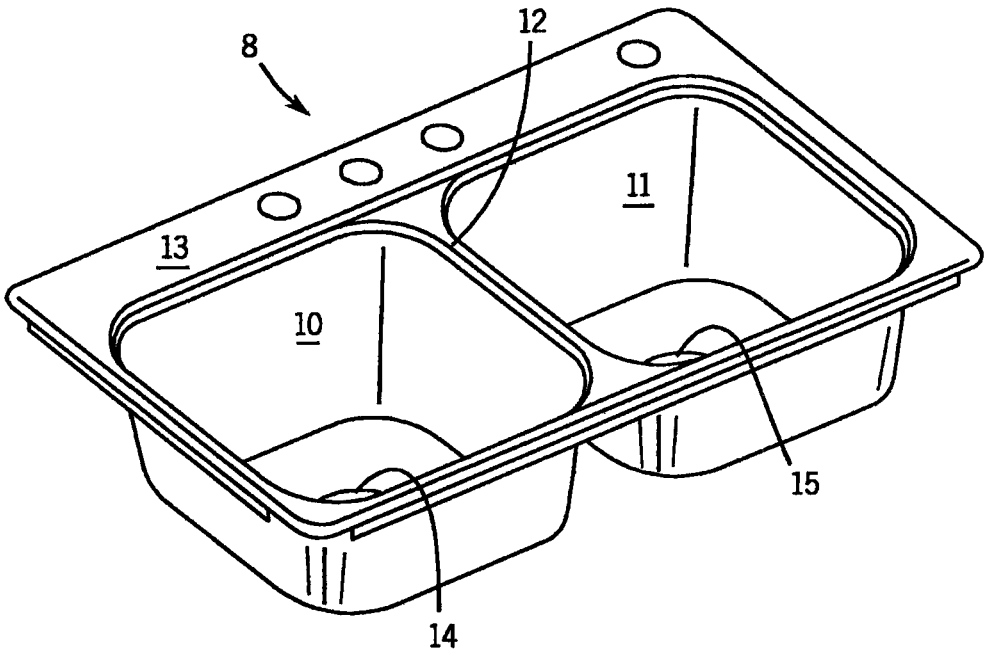
FIG. 1 is a top, frontal, left perspective view of a stainless steel sink of the present invention.

FIG. 1 depicts a kitchen sink 8 of the present invention. It has basins 10 and 11, with a saddle divider 12 there between. There is also an upper rim 13, and each basin has an outlet 14/15.

We prefer that the sink (apart from its chrome outer layer 25) be made of a uniform mix of about 73% iron, 18% chromium, 8% nickel and 1% carbon. As previously noted, the "stainless steel" base layer 23 could be otherwise formulated. For example, it could include minor amounts of Ag, Au, Cu, Co, Sn, Pt, Zn, Mo, W, B, P, S, and Si, and/or other additives such as metal oxide powders of Al, Co, Cu, In, Mg, Ni, Si, Sn, V, and/or Zn, and/or nitrides of Al, Band/or Si, and/or carbides of B, Cr, Bi, Si, and/or W. Still other additives are possible consistent with the base product being fairly characterizable as "stainless steel".

In one embodiment the base is formed using a conventional method from a sheet of such stainless steel (e.g. using compression molding, thermoforming, deep draw processing, casting, electroforming, or other techniques). We prefer to add the chrome after the basin has been formed.

A variety of processes are then suitable to deposit a chrome layer of the present invention on to the base, albeit we highly prefer electroplating. We can deposit chromium on flat surfaces (e.g. the floor of the sink basin) at the rate of about 20 to 40 microns per hour (with chromium being deposited at inward bends at a slower rate and at outward bends at a greater rate).

This can be achieved using a current density of about 3 $A/ft^2$, a bath temperature of 45° C. to 55° C., and a voltage of 4V to 12V for a dc rectifier. To process a sink of 1500 $in^2$, we prefer using two 10,000 amp rectifiers. Pulsed rectifiers and other power sources may be used, but dc rectifiers are preferred for this method.

In forming the bath we prefer an aqueous chromic acid mix of between 150 g/L (dilute bath) to 400 g/L (concentrated bath) used with sulfuric acid=1 g/L (dilute bath) or 4 g/L (concentrated bath). We intend that the $CrO_3$:$SO_4$ ratio equal 50:1 to 300:1, with a 75:1 to 250:1 ratio providing the harder deposit.

If desired a fluorosilicate catalyst can be present in the bath and/or a sulfate catalyst can be used. For example, potassium or sodium silicofluoride at 2.5 g/L will allow for faster deposition rates, albeit it may etch unplated areas.

See generally N. Zaki, Chromium Plating, PF Online (2008)(pfonline.com/articles/pfd0310) for general guidance as to electroplating using chromium in varied contexts.

Alternative processes for providing the chrome layer would be electroless (autocatalytic) plating, pulsed electrodeposition, and brush plating.

Particularly important is the way we use and construct our anodes during our processes. In this regard a conformal/generally mirroring anode is positioned above and adjacent the top of the sink, with a gap of about 1 to 3 inches (preferably 2 inches). This allows the bath liquid to flow onto the sink top below the anode, yet provides deposition of chromium at specific spots, with specific thicknesses, while minimizing the need for masking.

We prefer utilizing insoluble lead alloy anodes such as 93% lead, 7% antimony, in a mesh configuration. The anode may also be a solid or hollow piece of lead alloy, but the mesh design allows for solution to flow more freely and refresh faster.

Aside from the non-consumable lead alloy anodes, steel wire (a low cost, limited time use material) may also be used. If lead or steel are not used, precious metal anodes such as palladium, or precious metal surfaces such as platinized titanium have found only limited usefulness.

Our chromium plating is preferably performed in tanks with anodes hanging from rods. Work pieces to be plated, hanging from other rods, are then placed between the anodes and current applied.

To complete the circuit, at least one contact point must be present on a B side (non-aesthetic side) of the sink. By increasing the number of cathode contact points (or surface area), current is distributed more uniformly throughout the part, and hot spots are minimized.

Figure 2:
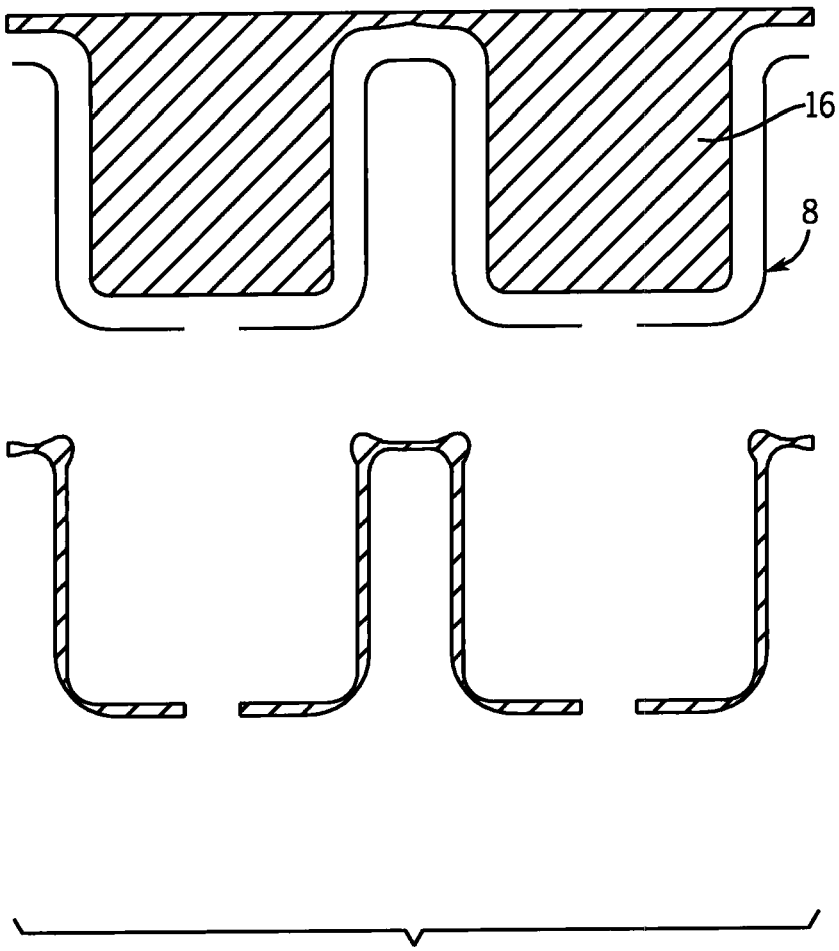
FIG. 2 are schematic views depicting use of one anode.

As will be appreciated from FIG. 2, anode 16 can be shaped to essentially mimic many of the contours of the top surface of the sink 8, so as to keep a relatively constant gap there between (e.g. about 2 inches). Current will tend to concentrate at edges/points of the sink that project outward towards the anode (as adjacent thereto multiple portions of the anode will be positioned). Thus, chromium will deposit more readily at the top edge of the sink basin, an area that is particularly at risk for scratching.

On the other hand, at the intersection of the basin side walls and basin floor there will be the least current, and thus the least chrome thickness. This is desirable as scratching is the least likely to occur at that intersection. Thus, this process surprisingly automatically achieves more optimal thicknesses as compared to a uniform layering system.

Figure 3:
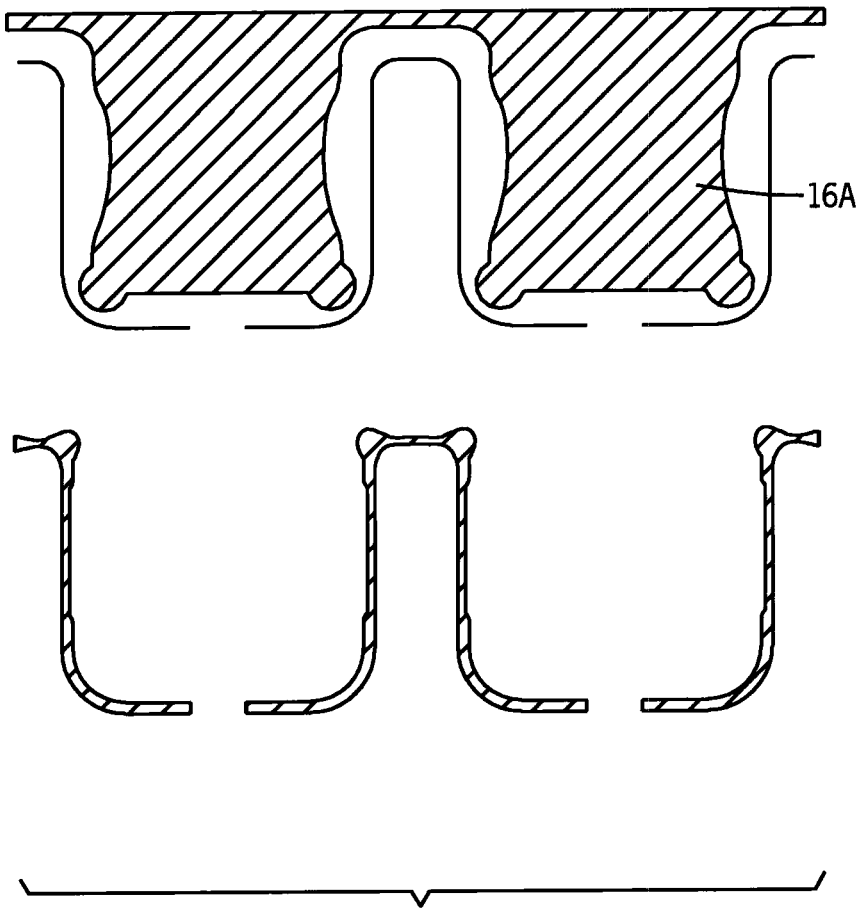
FIG. 3 is a view similar to FIG. 2, but where the anode is contoured to provide lower amounts of chrome along basin side walls.
Figure 4:
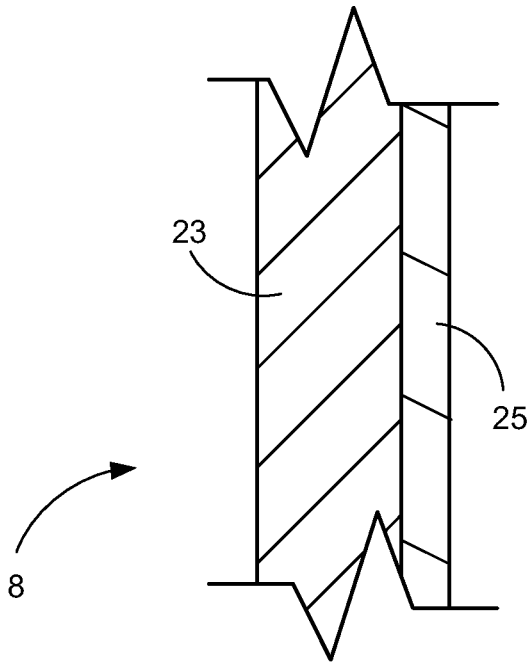
FIG. 4 is a cross-sectional view of the sink showing the exposed chrome layer positioned over the metallic base layer.

FIG. 3 shows a further refinement where the sides of the anode 16A dish a bit inward to create a greater gap at that point. This reduces the chrome layer thickness along the sides for any given time of electroplating. This can permit even greater differences in thicknesses than a uniform gap would, without experiencing a significant waste of metal.

We then tested the resistance and certain other characteristics of the sinks we formed in this manner. The results of our testing are as follows:

| | Chrome Thickness (microns) | Gram Load At Which Pick Begins Scratching | Vickers hardness ($HV_{200}$) | Rsm | Rhsc | Stain Resis. |
|---|---|---|---|---|---|---|
| A | 0 | 20 | 362 | 0.031 | 124 | Fair |
| | 0.5 | 20 | 369 | 0.031 | 134 | Good |
| | 2.5 | 20 | 356 | 0.028 | 136 | Good |
| | 5 | 50 | 358 | 0.027 | 147 | Good |
| | 10 | 100 | 379 | 0.032 | 137 | Good |
| | 15 | 200 | 371 | 0.029 | 133 | Good |
| | 20 | 500 | 414 | 0.030 | 125 | Good |
| | 25 | 500 | 462 | 0.030 | 131 | Good |
| B | 0 | 20 | 322 | 0.052 | 77 | Fair |
| | 13 | 500 | 413 | 0.087 | 45 | Good |
| | 25 | 500 | 429 | 0.063 | 61 | Good |
| | 38 | >500 | 571 | 0.067 | 59 | Good |
| | 51 | >500 | 715 | 0.079 | 52 | Good |

In judging stain resistance we used the ANSI Z.124.6.5.2-2007 protocol. Basically, specimens of the basin bottom were cut out from each sink. They were then conditioned by wet rubbing with a standard scouring compound and cheesecloth using twenty scrub cycles. Varied stain reagents (e.g. black crayon, black shoe polish, blue ink, gentian violet, beet juice, grape juice, lipstick, hair dye, 1% iodine alcohol solution, and tea) were applied to the specimens. Each stain reagent was left on the specimen, with a cover to minimize evaporation, at room temperature for about 16 hours, and then excess stain reagent was wiped off. The stain condition of the specimen was examined and subjectively judged.

In judging scratch resistance we challenged the specimen to a point scratch challenge. We used a #6 Mohs' pick to attempt to scratch the surface with various applied forces. In particular, we used a Pacific Scientifico balanced beam scrape adhesion and mar tester. We used a 20 gram weight on the weight support initially and then increased the applied weight where scratching did not occur under challenge.

Our sinks can even achieve a Vickers hardness of chromium on the order of 900 to 1100 VHN. By varying thicknesses along the surface, a unique color gradient or brush pattern can also be deposited along surface.

The results of our testing indicate that at even relatively low micron thicknesses of chrome, stain resistance can improve. However, below about 10 microns of chrome thickness the resistance to scratching in high wear areas will be significantly less.

We note that the effect of chrome thickness on hardness is offset to some extent by the underlying softer stainless steel substrate. Of course, as the chrome layer becomes thicker, the effect of the softer substrate decreases. Hence, this is another reason for the effect on hardness.

The above chart reflects tests of two different finishes to analyze the effect of brushing. The type of finishing operation on the sink turns out to have an impact on the scratch resistance. For example, as "Finish A" creates significantly more surface peaks which are located relatively close to each other than "Finish B", the scratch resistance score of Finish A will be lower than for Finish B. In this regard the tips of the stainless steel in Finish A will typically be more susceptible to breakage and deformation, thus revealing a scratch more easily.

To achieve these different finishes we directionally polished using Scotchbrite® pads to achieve visual lines which are roughly parallel to each other. The average roughness (Ra value) of both finishes were approximately the same, in the range of 0.6 microns to 1 micron. But, other two roughness parameters differentiate the samples.

Rsm is defined as the average spacing between positive mean line crossings. The distance between each positive (upward) mean line crossing is determine and the average value is reported. Rhsc is the number of peaks (high spots) over the assessment length. The Rhsc parameter reports the number of profile crossings above a user defined threshold. The threshold value is positive when above the mean line or negative when below the mean line.

Finish A had Rsm values between 0.027 microns and 0.032 microns, while Rhsc values ranged from 124 to 147. Finish B had Rsm values between 0.052 microns and 0.087 microns, while Rhsc values ranged from 45 to 77.

Vickers micro hardness testing (according to ASTM E 92-82) was performed using a 200 gram load on samples cut from the basin of the sinks. The equipment used to measure Vickers micro hardness was a Leco LM247 AT micro hardness tester with an Amh43-1.55 software package.

Thus, as can be seen from the above, with Finish A, the scratch resistance at even 15 microns was only 200, whereas with Finish B the scratch resistance was already 500 at 13 microns. Hence, the nature of the finishing can skew the scratch resistance somewhat.

What has been described thus far is merely the preferred embodiments of the invention. Various other modifications could be made without departing from the spirit and scope of the invention. For example, the chrome layer need not be entirely chrome. It should, however, be at least predominantly chrome, and preferably at least 95% chrome.

Also, chromic acid mist is highly toxic and may be generated in the plating process. Thus, the process may be modified so that the fixturing allows for capturing of the hexavalent chromium mist. For example, as the anode or sink get lowered into the bath, a plate with a vacuum port may seal the tank such that all undesired mist gets evacuated through the port.

Thus, the claims should be looked to in order to judge the full scope of the invention.

INDUSTRIAL APPLICABILITY

The present invention provides improved stain and scratch resistance for stainless steel sinks.

What is claimed is:

1. A plumbing fixture, comprising:

at least one basin;

a rim extending outward from an upper portion of the basin; and at least one outlet extending downward from a lower portion of the basin;

wherein the basin has a metallic base layer over which is positioned an exposed layer of chrome, the metallic base layer having a surface with an average surface roughness of between 0.6 and 1 micron, inclusive, an average spacing between positive mean line crossings of between 0.052 and 0.087 microns, inclusive, and an Rhsc value of between 45 and 77, inclusive;

wherein a first portion of the exposed layer of chrome adjacent a junction between the rim and a top portion of a basin side wall has a first thickness which is greater than 10 microns thick;

wherein a second portion of the exposed layer of chrome forming a portion of an upwardly facing floor of the basin has a second thickness which is greater than 20 microns thick; and wherein a third portion of the exposed layer of chrome adjacent a junction between a lower portion of the basin side wall and the floor of the basin has a third thickness which while greater than 1 micron thick is less thick than the first and second thicknesses.

2. The plumbing fixture of claim 1, wherein the plumbing fixture is a sink.

3. The plumbing fixture of claim 1, wherein the metallic base layer is a stainless steel layer that is etched and polished to have the surface roughness.

4. The plumbing fixture of claim 1, wherein the exposed layer of chrome comprises at least 90% chromium.

5. The plumbing fixture of claim 1, wherein chrome layer directly abuts against said metallic base layer.

6. The plumbing fixture of claim 1, wherein an upper surface of the fixture has a chrome layer applied thereon, whereas a bottom surface of the plumbing fixture does not.

7. The plumbing fixture of claim 1, wherein the exposed layer of chrome was deposited on a base portion of the basin after the base portion of the basin had been formed into a basin shape.

8. The plumbing fixture of claim 1, wherein the exposed layer of chrome is an electroplated chrome, an electroless plated chrome, a pulsed electrodepositioned chrome, or a brush plated chrome.

9. The plumbing fixture of claim 8, wherein during the electroplating process an anode having a shape essentially mirroring that of the basin's upper surface was used to cause chromium to plate on the base layer.

10. The plumbing fixture of claim 1, wherein at least one portion of the exposed layer of chrome has a Vickers hardness of between 900 and 1100, inclusive.

11. The plumbing fixture of claim 1, wherein at least one portion of the exposed layer of chrome will not be visually scratched when scraped using a Mohs hardness 6 pick with a load of 100 grams or less.

12. The plumbing fixture of claim 1, wherein the base layer has a brushed surface.

13. A plumbing fixture, comprising:

at least one basin having an upper portion; and a rim extending outward from the upper portion of the basin;

wherein the rim and basin have a stainless steel base layer, the stainless steel base layer having an average surface roughness of between 0.6 and 1 microns, inclusive, an average spacing between positive mean line crossings of between 0.052 and 0.087 microns, inclusive, and with an Rhsc value of between 45 and 77, inclusive;

wherein a first portion of an exposed layer of chrome is provided over the surface of the stainless steel base layer, such that the first portion of exposed chrome is configured to not be visually scratched when scraped using a Mohs hardness 6 pick with a load of 100 grams or less; and wherein a second portion of the exposed layer of chrome is provided over the surface of the stainless steel base layer, the second portion of exposed chrome being configured to not be visually scratched when scraped using a Mohs hardness 6 pick with a load of 500 grams or less.

14. The plumbing fixture of claim 13, wherein the first portion of the exposed chrome layer is provided over the stainless steel base layer between the rim and a basin side wall, and wherein the second portion of the exposed chrome layer is provided over the stainless steel base layer on an upwardly facing floor of the basin.

15. The plumbing fixture of claim 14, wherein the first portion of exposed chrome has a first thickness greater than 10 microns, and the second portion of exposed chrome has a second thickness greater than 20 microns.

16. The plumbing fixture of claim 15, further comprising a third portion of the exposed layer of chrome that is provided over the stainless steel base layer between the first and second portions, the third portion of exposed chrome being configured to not be visually scratched when scraped using a Mohs hardness 6 pick with a load of 50 grams or less.

17. The plumbing fixture of claim 16, wherein the third portion of exposed chrome has a third thickness which while greater than 1 micron is less thick than the first and second thicknesses.

18. The plumbing fixture of claim 17, wherein at least one portion of the exposed layer of chrome has a Vickers hardness of between 900 and 1100, inclusive.

19. The plumbing fixture of claim 18, wherein the stainless steel base layer comprises approximately 73 percent iron, 18 percent chromium, 8 percent nickel, and 1 percent carbon, and wherein the exposed layer of chrome comprises at least 95 percent chrome.

20. A sink, comprising:

a floor having an outlet disposed therein;

a side wall extending upwardly from the floor:

a first junction connecting the floor and side wall;

a rim extending outward from the side wall; and a second junction connecting the rim and side wall;

wherein the sink includes an exposed layer of chrome provided over a stainless steel base layer polished to have a surface roughness with an average spacing between positive mean line crossings of between 0.052 and 0.087 microns, inclusive, and an Rhsc value of between 45 and 77, inclusive;

wherein a thickness of the exposed layer of chrome at the floor is between 20 and 40 microns, inclusive;

wherein a thickness of the exposed layer of chrome at the first junction is between 1 and 15 microns, inclusive;

wherein a thickness of the exposed layer of chrome at the second junction is at least 50 microns; and wherein the exposed layer of chrome at least at one of the floor, the first junction, and the second junction has a Vickers hardness of between 900 and 1100, inclusive.

* * * * *